US007952544B2

(12) United States Patent
Roberts

(10) Patent No.: US 7,952,544 B2
(45) Date of Patent: May 31, 2011

(54) PARTIALLY FILTERLESS LIQUID CRYSTAL DISPLAY DEVICES AND METHODS OF OPERATING THE SAME

(75) Inventor: John Roberts, Grand Rapids, MI (US)

(73) Assignee: Cree, Inc., Durham, NC (US)

( * ) Notice: Subject to any disclaimer, the term of this patent is extended or adjusted under 35 U.S.C. 154(b) by 1130 days.

(21) Appl. No.: 11/675,250

(22) Filed: Feb. 15, 2007

(65) Prior Publication Data

US 2008/0198112 A1 Aug. 21, 2008

(51) Int. Cl.
*G09G 3/36* (2006.01)

(52) U.S. Cl. ..... 345/87; 345/88; 345/89; 345/102

(58) Field of Classification Search ..... 345/87–102, 345/204–215

See application file for complete search history.

(56) References Cited

U.S. PATENT DOCUMENTS

| | | | | |
|---|---|---|---|---|
| 6,037,921 | A * | 3/2000 | Matsumoto et al. | 345/88 |
| 7,551,204 | B2 * | 6/2009 | Muraki | 348/222.1 |
| 2002/0075224 | A1 | 6/2002 | Son | |
| 2006/0007105 | A1 | 1/2006 | Chen et al. | |
| 2006/0221044 | A1 | 10/2006 | Negley et al. | |
| 2010/0110114 | A1 * | 5/2010 | Hashimoto | 345/691 |

FOREIGN PATENT DOCUMENTS

| | | | |
|---|---|---|---|
| EP | 0875880 | A2 | 11/1998 |
| EP | 1202244 | A1 | 5/2002 |
| EP | 1715473 | A2 | 10/2006 |

OTHER PUBLICATIONS

Notification of Transmittal of The International Search Report and The Written Opinion of the International Searching Authority, or the Declaration corresponding to International Application No. PCT/US2008/001825 mailed Jun. 12, 2008.

IBM Corp. "Brightness and Color Temperature Control on Thin Film Transistor/Liquid Crystal Display", *IBM Technical Disclosure Bulletin* 40(8):27 (1997).

Invitation to Pay Additional Fees And, Where Applicable, Protest Fee corresponding to International Application No. PCT/US2008/002068 mailed Jun. 20, 2008.

Toshiba Matsushita Display Announces The World's Highest Level of High Transmittance, Wide Viewing Angle and High Speed 9-inch Field Sequential OCB-LCD; Apr. 17, 2006; http://www.tmdisplay.com/tm_dsp/press/2006/06-04-17.htm; located Oct. 26, 2010; pp. 1-3.

* cited by examiner

*Primary Examiner* — Vijay Shankar

(74) *Attorney, Agent, or Firm* — Myers Bigel Sibley & Sajovec, P.A.

(57) ABSTRACT

A liquid crystal display (LCD) device includes a backlight configured to emit first, second, and/or third colors of light, and a backlight controller. The backlight controller is configured to activate the backlight to simultaneously emit the first and second colors of light to generate a first image component including a combination of first color image data and second color image data, and to separately emit the third color of light at a different time than the first and second colors of light to generate a second image component including third color image data. The LCD device is configured to display the first and second image components to provide a single image frame. Related devices and methods of operation are also discussed.

40 Claims, 7 Drawing Sheets

PARTIALLY FILTERLESS LIQUID CRYSTAL DISPLAY DEVICES AND METHODS OF OPERATING THE SAME

FIELD OF THE INVENTION

The present invention relates to liquid crystal display devices and methods of operating the same.

BACKGROUND OF THE INVENTION

A liquid crystal display (LCD) device is a relatively thin, flat display device made up of a number of color or monochrome pixels arrayed in front of a light source or reflector. For example, an LCD device may include an LCD screen including a pixel array, and a backlight arranged behind the LCD screen such that the pixel array is positioned to receive light emitted by the backlight. In a full-color LCD device, each pixel of the pixel array may include three subpixels configured to display red, green, and blue light, respectively. More particularly, each subpixel may include a liquid crystal shutter and a color filter configured to display one of the three (red, green, or blue) colors of light. In order to form an image, the shutters of the subpixels may be opened for differing time intervals in each refresh cycle, and the corresponding color filters may display their respective colors when the shutters are opened. The length of the time interval in which each shutter is opened may determine the intensity of the color displayed in the subpixel, and the combination of the red, green, and blue colors may provide a full-color pixel. An array of full-color pixels may be used to generate a full-color image.

FIG. 1 schematically illustrates a conventional LCD display device 100. As shown in FIG. 1, the display device 100 includes a backlight 102 and an LCD screen 105. The backlight 102 is configured to emit light having a white or near-white color, which may be used to illuminate the LCD screen 105. The LCD screen 105 includes an array of red, green, and blue (RGB) color filters 130, and a corresponding array of liquid crystal shutters 120. The red color filter 130*r* is configured to allow passage of red light, but prevent passage of green and blue light. Similarly the green color filter 130*g* and the blue color filter 130*b* are configured to allow passage of green and blue light, respectively, and prevent passage of other colors of light. The liquid crystal shutters 120 are controlled by a shutter controller 110. Each group of red, green, and blue color filters 130 and the corresponding liquid crystal shutters 120 are arranged to form four pixels 115*a*-115*d*. In each display cycle, the shutter controller 110 is configured to selectively open the liquid crystal shutters 120 for predetermined periods of time to combine the red, green, and/or blue light provided by the color filters 130 such that each pixel 115*a*-115*d* displays a desired color at a desired brightness level.

SUMMARY OF THE INVENTION

According to some embodiments of the present invention, a liquid crystal display (LCD) device includes a backlight configured to emit first, second, and/or third colors of light, and a backlight controller. The backlight controller is configured to activate the backlight to simultaneously emit the first and second colors of light to generate a first image component including a combination of first color image data and second color image data, and to separately emit the third color of light at a different time than the first and second colors of light to generate a second image component including third color image data. The LCD device is configured to display the first and second image components to provide a single image frame.

In some embodiments, the LCD device may further include a pixel array including a plurality of pixels configured to sequentially display the first and second image components to provide the image. The plurality of pixels may include a first subpixel configured to display the first color image data, a second subpixel configured to display the second color image data, and a third subpixel configured to display the third color image data. The first subpixel may include a first liquid crystal shutter configured to be activated to an open position and a closed position, and a first color filter configured to allow passage of the first color of light and prevent passage of the second color of light. Similarly, the second subpixel may include a second liquid crystal shutter configured to be activated to an open position and a closed position, and a second color filter configured to allow passage of the second color of light and prevent passage of the first color of light. The third subpixel may include a third liquid crystal shutter configured to be activated to an open position and a closed position; however, the third subpixel may not include a color filter.

In other embodiments, the LCD device may further include a shutter controller coupled to the pixel array. The shutter controller may be configured to selectively activate the first and second liquid crystal shutters to the open position and activate the third liquid crystal shutter to the closed position to generate the first image component. The shutter controller may also be configured to selectively activate the third liquid crystal shutter to the open position to generate the second image component.

In some embodiments, the shutter controller may be configured to selectively activate the first and second liquid crystal shutters to the open position when the backlight is activated to simultaneously emit the first and second colors of light to combine the first color image data and the second color image data. In addition, the shutter controller may be configured to activate the third liquid crystal shutter to the closed position when the backlight is activated to simultaneously emit the first and second colors of light to prevent passage of the first and second colors of light.

In other embodiments, the shutter controller may be configured to selectively activate the third liquid crystal shutter to the open position when the backlight is activated to emit the third color of light to allow passage of the third color of light. In addition, the shutter controller may be configured to activate the first and second liquid crystal shutters to the closed position when the backlight is activated to emit the third color of light, for example, where the first and second color filters are configured to allow passage of the third color of light.

In some embodiments, the first and second color filters may be further configured to prevent passage of the third color of light. As such, the backlight controller may be configured to simultaneously emit the first, second, and third colors of light to generate the first image component, as the first and second color filters may prevent passage of the third color of light. In addition, in some embodiments, the shutter controller may be configured to activate the first and/or second liquid crystal shutters to the open position when the backlight is activated to emit the third color of light.

In other embodiments, the shutter controller may be configured to accelerate a shutter rate of the first, second, and/or third liquid crystal shutters to provide a predetermined refresh rate. In addition, the backlight controller may be configured to alternate between activating the backlight to emit the first and second colors of light simultaneously and activating the backlight to emit the third color of light at a different time than the first and second colors of light based on the shutter rate.

In some embodiments, the backlight may be a solid state lighting panel including a first solid state lighting element configured to emit the first color of light, a second solid state lighting element configured to emit the second color of light, and a third solid state lighting element configured to emit the third color of light. The backlight controller may be configured to activate the first and second solid state lighting elements substantially simultaneously to generate the first image component, and may be configured to activate the third solid state lighting element at a different time than the first and second solid state lighting elements to generate the second image component.

In some embodiments, a wavelength of the third color of light may be greater than a wavelength of the second color of light but less than a wavelength of the first color of light. For example, the first color of light may be red light, the second color of light may be blue light, and the third color of light may be green light. Also, the first color of light may be magenta light, the second color of light may be cyan light, and the third color of light may be yellow light.

In other embodiments, the first color of light may be blue light, the second color of light may be green light, and the third color of light may be red light. In still other embodiments, the first color of light may be green light, the second color of light may be red light, and the third color of light comprises blue light.

According to other embodiments of the present invention, a solid state lighting panel includes a first solid state lighting element configured to emit light of a first color, a second solid state lighting element configured to emit light of a second color, and a third solid state lighting element configured to emit light of a third color. The solid state lighting panel further includes a lighting controller configured to activate the first and second solid state lighting elements substantially simultaneously to generate a first image component including a combination of image data of the first and second colors, and to activate the third solid state lighting element at a different time than the first and second solid state lighting elements to generate a second image component including image data of the third color. The first and second image components are configured to be sequentially displayed to provide a single image frame.

In some embodiments, the lighting controller may be further configured to alternate between activating the first and second solid state lighting elements substantially simultaneously and activating the third solid state lighting element at a predetermined frequency to provide a predetermined refresh rate.

In other embodiments, the lighting controller may be configured to activate the first, second, and third solid state lighting elements substantially simultaneously to generate the first image component.

In some embodiments, the first, second, and/or third solid state lighting elements may be light-emitting diodes (LEDs), organic light-emitting diode (OLEDs), and/or laser light sources.

In some embodiments, the third solid state lighting element may be configured to emit light having a wavelength that is between the wavelengths of the light emitted by the first and second solid state lighting elements. For example, the third solid state lighting element may be configured to emit green light, the first solid state lighting element may be configured to emit red light, and the second solid state lighting element may be configured to emit blue light. Also, the third solid state lighting element may be configured to emit yellow light, the first solid state lighting element may be configured to emit magenta light, and the second solid state lighting element may be configured to emit cyan light.

In other embodiments, the third solid state lighting element may be configured to emit red light. In still other embodiments, the third solid state lighting element may be configured to emit blue light.

According to further embodiments of the present invention, a screen for use in a liquid crystal display (LCD) device includes a pixel array. The pixel array includes a plurality of pixels configured to display an image. The plurality of pixels respectively include a first subpixel configured to display first color image data, a second subpixel configured to display second color image data, and a third subpixel configured to display third color image data. The first subpixel includes a first liquid crystal shutter configured to be activated to an open position and a closed position, and a first color filter configured to allow passage of a first color of light and prevent passage of a second color of light. The second subpixel includes a second liquid crystal shutter configured to be activated to an open position and a closed position, and a second color filter configured to allow passage of the second color of light and prevent passage of the first color of light. The third subpixel includes a third liquid crystal shutter configured to be activated to an open position and a closed position. The third subpixel does not include a color filter.

In some embodiments, the screen may include a shutter controller. The shutter controller may be configured to selectively activate the first and second liquid crystal shutters to the open position to generate a first image component including a combination of the first color image data and the second color image data. The shutter controller may be further configured to selectively activate the third liquid crystal shutter to the open position to generate a second image component including the third color image data. The pixel array may be configured to sequentially display the first and second image components to provide the image.

In other embodiments, the shutter controller may be configured to activate the third liquid crystal shutter to the closed position to generate the first image component. In addition, the shutter controller may be further configured to activate the first and second liquid crystal shutters to the closed position to generate the second image component, for example, where the first and second color filters are configured to allow passage of the third color of light.

In some embodiments, the first and second color filters may be further configured to prevent passage of the third color of light. As such, the shutter controller may be configured to activate the first and/or second liquid crystal shutters to the open position to generate the second image component.

In other embodiments, the shutter controller may be configured to accelerate a shutter rate of the first, second, and third shutters to provide a predetermined refresh rate.

According to some embodiments of the present invention, a method for operating a liquid crystal display (LCD) device including a backlight and a pixel array includes activating the backlight to simultaneously emit first and second colors of light to generate a first image component, and activating the backlight to separately emit a third color of light at a different time than the first and second colors of light to generate a second image component. The first image component includes a combination of first color image data and second color image data, and the second image component includes third color image data. The pixel array is activated to sequentially display the first and second image components to provide a single image frame.

In some embodiments, the pixel array may include a plurality of pixels, which may respectively include first, second, and third subpixels. The first, second, and third subpixels may include first, second, and third liquid crystal shutters, respectively. The first and second liquid crystal shutters may be selectively activated to an open position and the third liquid crystal shutter may be activated to a closed position to generate the first image component. The third liquid crystal shutter may be selectively activated to an open position to generate the second image component.

In other embodiments, the first and second liquid crystal shutters may be activated to the open position concurrently with activation of the backlight to simultaneously emit the first and second colors of light to combine the first color image data and the second color image data. In addition, the third liquid crystal shutter may be activated to the closed position concurrently with activation of the backlight to simultaneously emit the first and second colors of light to prevent passage of the first and second colors of light.

In some embodiments, the third liquid crystal shutter may be selectively activated to the open position concurrently with activation of the backlight to emit the third color of light to allow passage of the third color of light. In addition, in other embodiments, the first and second liquid crystal shutters may be activated to the closed position concurrently with activation of the backlight to emit the third color of light, for example, where the first and second subpixels respectively include first and second color filters configured to allow passage of the third color of light.

In other embodiments, the first and second subpixels may respectively include first and second color filters configured to prevent passage of the third color of light. As such, the first and/or second liquid crystal shutters may be activated to the open position concurrently with activation of the backlight to emit the third color of light.

In some embodiments, the first and second subpixels may respectively include first and second color filters configured to prevent passage of the third color of light. As such, the backlight may be activated to simultaneously emit the first, second, and third colors of light to generate the first image component.

In other embodiments, a shutter rate of the first, second, and/or third liquid crystal shutters may be accelerated to provide a predetermined refresh rate. In addition, the backlight may be activated to alternate between emitting the first and second colors of light simultaneously and emitting the third color of light based on the shutter rate.

In other embodiments, the backlight may include first, second, and third solid state lighting elements respectively configured to emit light of the first, second, and third colors. The first and second solid state lighting elements may be activated substantially simultaneously to generate the first image component, and the third solid state lighting element may be activated at a different time than the first and second solid state lighting elements to generate the second image component.

According to other embodiments of the present invention, a method for operating a solid state lighting device includes simultaneously emitting first and second colors of light to generate a first image component, and separately emitting a third color of light at a different time than the first and second colors of light to generate a second image component. The first image component includes a combination of first color image data and second color image data, and the second image component includes third color image data. The first and second image components are configured to be sequentially displayed to provide a single image frame.

In some embodiments, the method may include alternating between emitting the first and second colors of light simultaneously and emitting the third color of light at a predetermined frequency to generate the first and second image components a predetermined refresh rate.

In other embodiments, the first, second, and third colors of light may be simultaneously emitted to generate the first image component.

In some embodiments, the solid state lighting device may include first, second, and third solid state lighting elements configured to emit first, second, and third colors of light, respectively. The first and second solid state lighting elements may be activated substantially simultaneously to generate the first image component, and the third solid state lighting element may be activated at a different time than the first and second solid state lighting elements to generate the second image component.

DETAILED DESCRIPTION OF EMBODIMENTS OF THE INVENTION

Figure 1:
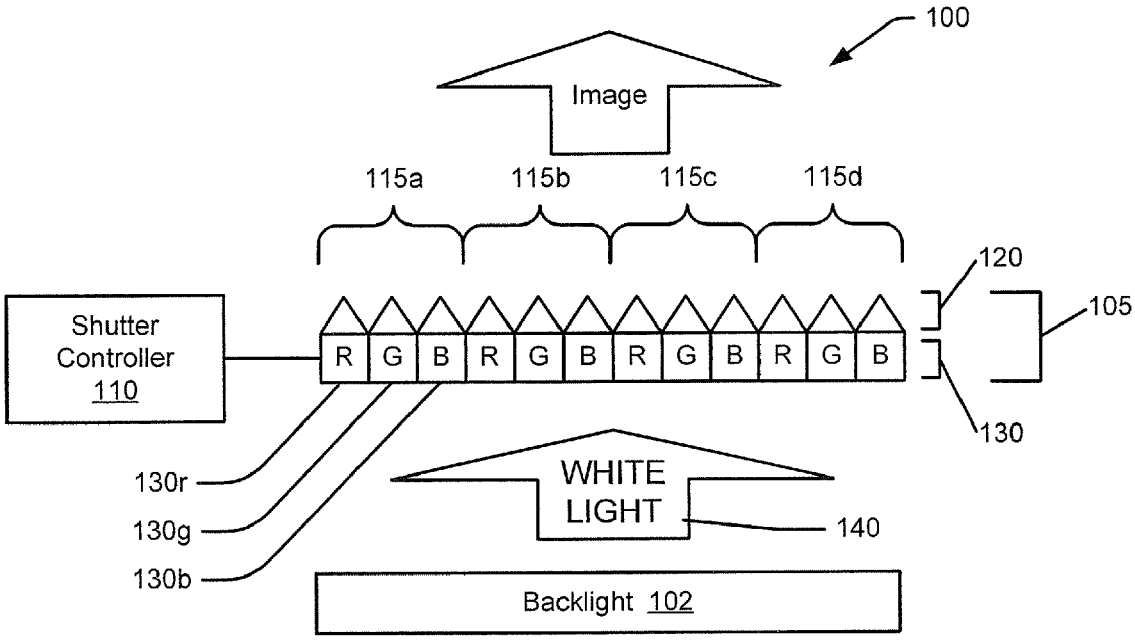
FIG. 1 (PRIOR ART)
FIG. 1 is a block diagram illustrating a conventional LCD device.

The present invention now will be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. In the drawings, the thicknesses of layers and/or regions are exaggerated for clarity. Like numbers refer to like elements throughout.

It will be understood that, although the terms first, second, third, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The present invention is described below with reference to flowchart illustrations and/or block and/or flow diagrams of methods, devices, and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block and/or flow diagram block or blocks.

These computer program instructions may also be stored in a computer-readable memory that can direct a computer or other programmable processor to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processor to cause a series of operational steps to be performed on the computer or other programmable processor to produce a computer implemented process such that the instructions which execute on the computer or other programmable processor provide steps for implementing the functions or acts specified in the flowchart and/or block diagram block or blocks. It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Unless otherwise defined, all terms used in disclosing embodiments of the invention, including technical and scientific terms, have the same meaning as commonly understood by one of ordinary skill in the art to which this invention belongs, and are not necessarily limited to the specific definitions known at the time of the present invention being described. Accordingly, these terms can include equivalent terms that are created after such time. It will be further understood that terms, such as those defined in commonly used dictionaries, should be interpreted as having a meaning that is consistent with their meaning in the present specification and in the context of the relevant art and will not be interpreted in an idealized or overly formal sense unless expressly so defined herein. All publications, patent applications, patents, and other references mentioned herein are incorporated by reference in their entirety.

Some embodiments of the present invention provide devices and methods for sequentially displaying first and second image components to provide a single full-color image using an LCD device including filters of two colors, but no filter of the third color. For example, some backlights may be configured to separately emit red, green, and blue light in sequence to provide red, green, and blue color image data, which may be perceived as a full-color image by a viewer. As such, an LCD display may be provided without the use of one or more color filters by coordinating the opening of the red, green, and blue liquid crystal shutters of the display with the activation of the desired color in the backlight. As a color filter may inadvertently block at least some portion of a desired color of light near the cutoff wavelength of the color filter, removal of one or more color filters may reduce losses that may affect the brightness and/or efficiency of the display. For example, in some embodiments of the present invention, the LCD device may include red and blue color filters, but no green color filters. Since green may dominate the luminance of a display, removal of the green color filters in LCD devices according to some embodiments of the present invention may provide improved brightness and/or efficiency. In addition, as the color filters may represent a significant portion of the overall cost of an LCD device, LCD devices according to some embodiments of the present invention may allow for reduced production costs as compared to conventional LCD devices.

Figure 2A:
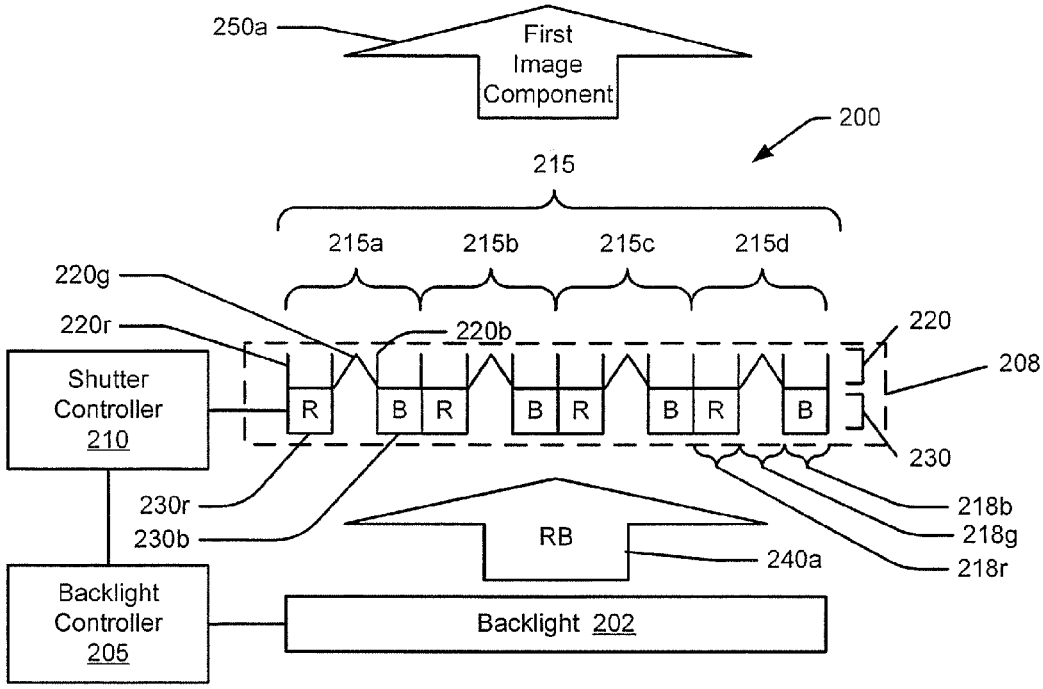
FIGS. 2A and 2B are block diagrams illustrating LCD devices and methods of operation according to some embodiments of the present invention.
Figure 2B:
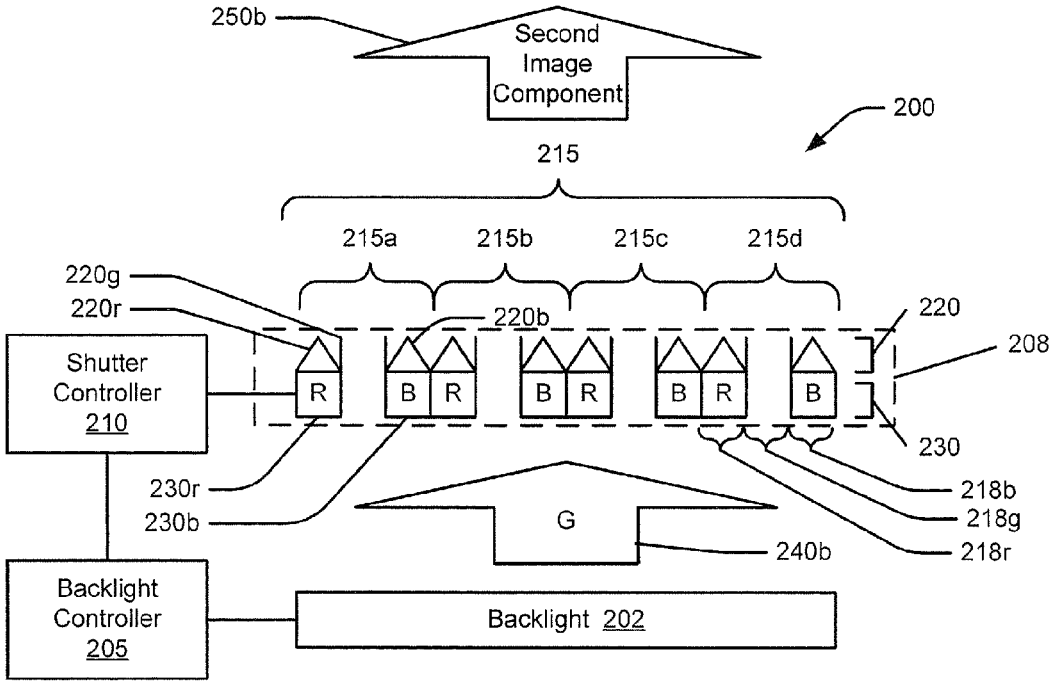

FIGS. 2A and 2B illustrate an LCD device 200 and methods of operation according to some embodiments of the present invention. Referring now to FIGS. 2A and 2B, the LCD device 200 includes a backlight 202 and an LCD screen 208. The backlight 202 is configured to emit first, second, and/or third colors of light, sequentially and/or simultaneously. More particularly, the backlight 202 is configured to emit red, green, and/or blue light. The LCD screen 208 includes a pixel array 215 including a plurality of pixels 215*a*-215*d*. Each of the pixels 215*a*-215*d* includes first, second, and third subpixels 218*r*, 218*b*, and 218*g*, configured to display red, blue, and green color image data, respectively. Each of the subpixels 218*r*, 218*b*, and 218*g* includes a liquid crystal shutter 220 configured to be activated to an open position and a closed position to display a particular color of light. In addition, some of the subpixels 218*r* and 218*b* include color filters 230 configured to allow passage of a first color of light, and prevent passage of second and third colors of light.

More particularly, as shown in FIGS. 2A and 2B, the subpixel 218*r* includes a red color filter 230*r* configured to allow passage of red light and prevent passage of blue and green light, and a liquid crystal shutter 220*r* configured to be activated to an open position and a closed position to display the red color image data. Similarly, the subpixel 218*b* includes a blue color filter 230*b* configured to allow passage of blue light and prevent passage of red and green light, and a liquid crystal shutter 220*b* configured to be activated to an open position and a closed position to display the blue color image data. The subpixel 218*g* also includes a liquid crystal shutter 220*g* configured to be activated to an open position and a closed position; however, the subpixel 218*g* does not include a color filter. As such, the liquid crystal shutter 220*g* is configured to be selectively activated to perform a filtering function, i.e., to allow passage of green light and prevent passage of red and/or blue light to display the green color image data.

Accordingly, the shutters 220 and the backlight 202 may be selectively activated to display the red, blue, and green color image data to provide a full-color image. More particularly, as shown in FIGS. 2A and 2B, the LCD device 200 includes a backlight controller 205 coupled to the backlight 202 and a shutter controller 210 coupled to the LCD screen 208. The backlight controller 205 is configured to activate the backlight 202 to simultaneously emit two colors of light to generate a first image component, and to emit a third color of light separately from the first and second colors of light to generate a second image component. More particularly, the backlight controller 205 may be configured to activate the backlight 202 to separately emit the third color of light at a different time than the first color of light. However, it is to be understood that there may be some negligible overlap between the time of emission of the third color of light and the time of emission of the first and second colors of light. As such, the first image component includes a combination of color image data for the two colors of light, and the second image component includes color image data for the third color of light. In addition, the shutter controller 210 is configured to selectively activate two liquid crystal shutters 220*r* and 220*b* of each pixel to the open position and activate the third liquid crystal shutter 220*g* to the closed position to generate the first image component, and to selectively activate the third liquid crystal shutter 220*g* of each pixel to the open position to generate the second image component. The first and second image components may be sequentially displayed by the LCD device 200 to provide a single full-color image frame.

More particularly, as shown in FIG. 2A, the backlight controller 205 activates the backlight 202 to simultaneously emit both red and blue light 240*a*. For example, the backlight 202 may include a plurality of red, blue, and green light emitting diodes (LEDs), and the backlight controller 205 may be configured to activate the red and blue LEDs substantially simultaneously to emit the red and blue light 240*a*. Also, the shutter controller 210 selectively activates the liquid crystal shutters 220*r* and 220*b* to the open position and activates the liquid crystal shutters 220*g* to the closed position when the backlight 202 is activated to simultaneously emit the red and blue light 240*a*. As such, the closed liquid crystal shutters 220*g* prevent the passage of the red and blue light 240*a* through the subpixels 218*g*, while the open liquid crystal shutters 220*r* and 220*b* and the corresponding red and blue color filters 230*r* and 230*b* allow the passage of red light through the subpixels 218*r* and blue light 240*a* through the subpixels 218*b* to display both red and blue color image data in each of the pixels 215*a*-215*d*. As such, the red color image data and the blue color image data are combined to provide the first image component 250*a*.

In addition, as shown in FIG. 2B, the backlight controller 205 activates the backlight 202 to separately emit green light 240*b* at a different time than the red and blue light 240*a* of FIG. 1, and the shutter controller 210 selectively activates the liquid crystal shutters 220*g* to the open position to allow passage of the green light 240*b* through the subpixels 218*g* when the backlight 202 is activated to emit the green light 240*b*. In other words, the shutter controller 210 selectively activates the liquid crystal shutters 220*g* to allow passage of green light. Since the shutters 220*g* are activated when the backlight 202 is only emitting green light, the subpixel 218*g* can display the green image data without the use of a color filter. The shutter controller 210 may also activate the liquid crystal shutters 220*r* and 220*b* to the closed position when the backlight 202 is activated to emit the green light 240*b* to prevent the passage of green light through the subpixels 218*r* and 218*b*. However, in some embodiments, the liquid crystal shutters 220*r* and/or 220*b* may be activated to the open position when the backlight 202 is activated to emit the green light 240*b*, as the corresponding color filters 230*r* and 230*b* may prevent the passage of green light through the subpixels 218*r* and 218*b*. Thus, the green color image data is displayed in each of the pixels 215*a*-215*d* to provide the second image component 250*b*. Accordingly, the backlight controller 205 and the shutter controller 210 may rapidly alternate between the shutter/backlight configuration illustrated in FIG. 2A and the shutter/backlight configuration illustrated in FIG. 2B to sequentially display the first and second image components 250*a* and 250*b* to provide a single full-color image.

In addition, as the color filters 230*r* and 230*b* may be configured to prevent passage of green light, the backlight controller 205 may be configured to activate the backlight 202 to simultaneously emit red, green, and blue light to generate the first image component 250*a* in some embodiments. In other words, even when the liquid crystal shutters 220*r* and 220*b* are activated to the open position, the color filters 230*r* and 230*b* may prevent any green light emitted by the backlight 202 from being displayed by the subpixels 218*r* and 218*b*. As such, the backlight controller 205 may be configured to activate the backlight 202 to constantly emit the green light 240*b* as shown in FIG. 2B, and may be configured to activate the backlight 202 to alternately emit the red and blue light simultaneously with the green light to provide a single full-color image frame.

Also, the shutter controller 210 may be configured to accelerate a shutter rate of the liquid crystal shutters 220 to provide a predetermined image refresh rate. For example, in order to sequentially display the first image component 250*a* and the second image component 250*b* to provide each image frame, the shutter controller 210 may activate the liquid crystal shutters 220 at double the refresh rate to provide a similar image refresh rate as that of a conventional liquid crystal display, such as the liquid crystal display 100 of FIG. 1. As such, the backlight controller 205 may also be configured to activate the backlight 202 based on the increased shutter rate of the shutters 220. More specifically, as the switching rate of the shutters 220 may be a limiting factor as compared to the switching rate of the backlight 202, the backlight controller 205 may be configured to alternate between activating the backlight 202 to simultaneously emit the red and blue light 240*a* and activating the backlight 202 to separately emit the green light 240*b* based on the switching rate of the shutters 220. In other words, the backlight controller 205 may be configured to activate the backlight 202 to simultaneously emit the red and blue light when the liquid crystal shutters 220*g* are activated to the closed position to generate the first image component 250*a*, and may be configured to activate the backlight 202 to separately emit the green light 240*b* at a different time than the red and blue light when the liquid crystal shutters 220*g* are in the open position to generate the second image component 250*b* to provide each image frame. However, in some embodiments, the shutter controller 210 may not accelerate the switching rates of the liquid crystal shutters 220, and the liquid crystal display 200 may sequentially display the first and second image components 250*a* and 250*b* to provide each image frame at half of the refresh rate of a conventional liquid crystal display, which may also be visibly acceptable.

Although FIGS. 2A and 2B illustrate exemplary liquid crystal display devices and methods of operation according to some embodiments of the present invention, it will be understood that some embodiments of the present invention are not limited to such a configuration, but is intended to encompass any configuration capable of carrying out the operations described herein. For example, although the liquid crystal display device 200 is illustrated as being configured to sequentially display the first image component 250*a* before the second image component 250*b*, it is to be understood that the liquid crystal display device 200 may display the second image component 250*b* prior to the first image component

250*a* to provide each image frame in some embodiments. In addition, although illustrated as simultaneously emitting red and blue light 240*a* and separately emitting green light 240*b*, it is to be understood that the backlight 202 may be configured to emit any two colors of light simultaneously, and may separately emit a remaining third color of light at a different time than the first and second colors of light, or vice versa. Furthermore, although the LCD screen 208 is illustrated as including only red and blue color filters and no green color filter, it is to be understood that the LCD screen 208 may include filters of any two colors, with no filter of the third color. As such, the backlight controller 205 may be configured to activate the backlight 202 to separately emit a color of light corresponding to the missing color filter in the LCD screen 208, and to simultaneously emit the remaining two colors of light. More generally, the backlight 202 and the LCD screen 208 may be activated to provide any two-image component sequence to display a single full-color image frame, where one image component includes only one of red, green, or blue color image data, and where the other image component includes a combination of color image data for the remaining two colors.

Figure 3A:
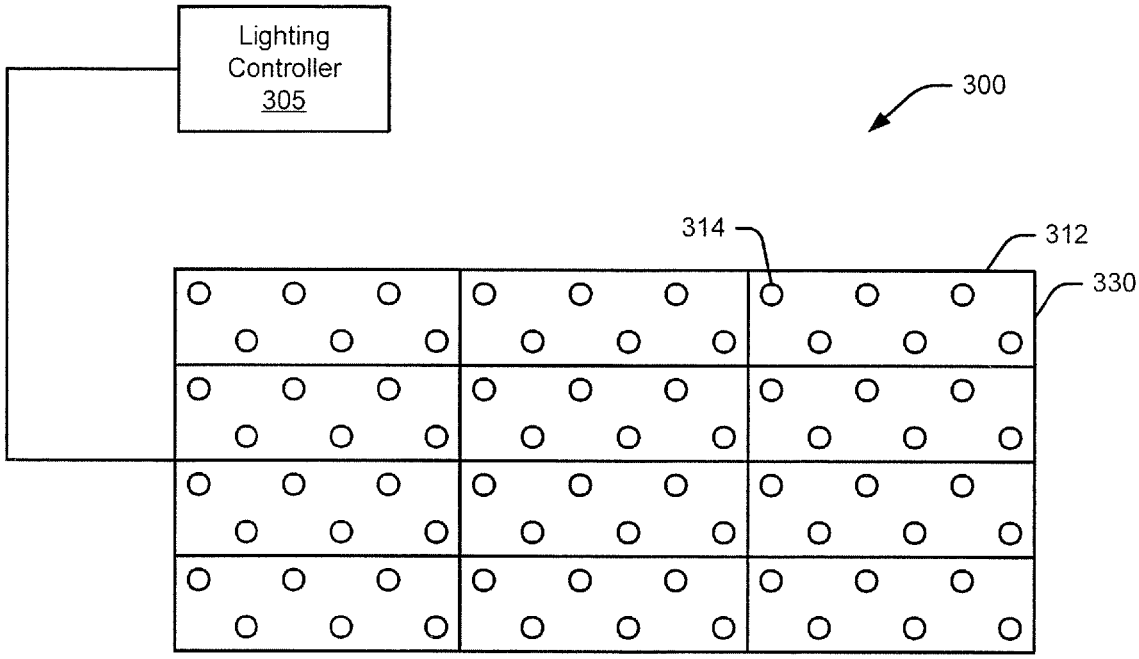
FIGS. 3A to 3C are block diagrams illustrating solid state lighting panels and methods of operation according to some embodiments of the present invention.
Figure 3B:
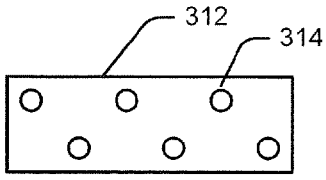
Figure 3C:
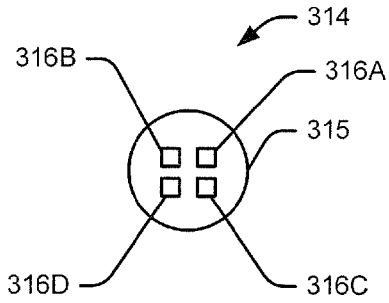

FIGS. 3A to 3C are block diagrams illustrating solid state lighting devices and methods of operation according to some embodiments of the present invention. Referring now to FIG. 3A, a solid state lighting panel 300 includes a plurality of solid state lighting tiles 312 mounted in an array. More particularly, a plurality of tiles 312 may be mounted in a linear array to form a bar assembly 330, and a plurality of the bar assemblies 330 may be arranged to form the two-dimensional lighting panel 300. For example, the solid state lighting panel 300 may be used as a backlighting unit in an LCD device, such as the backlight 202 in the LCD device 200 of FIGS. 2A and 2B. As shown in FIG. 3A, the lighting panel 300 may include four bar assemblies, each of which may include three tiles 312; however, fewer or more tiles and/or bar assemblies may be provided in some embodiments of the present invention.

FIG. 3B illustrates a solid state lighting tile 312 according to some embodiments of the present invention. Referring now to FIG. 3B, the tile 312 includes a plurality of solid state lighting devices 314 arranged in a regular and/or irregular pattern on the tile 312. The solid state lighting devices 314 may include, for example, organic light emitting devices (OLEDs), inorganic light emitting diodes (LEDs), and/or laser diodes. The tile 312 may also include other elements (not shown), coupled to the lighting devices 314, such as interconnect lines, electronic circuitry, connectors, test pads, and/or other elements. The tile 312 may include, for example, a printed circuit board (PCB) on which one or more circuit elements may be mounted. Suitable tiles are disclosed and commonly assigned U.S. Provisional Application Ser. No. 60/749,133 entitled "Solid State Backlighting Unit Assembly and Methods" filed Dec. 9, 2005.

FIG. 3C illustrates a solid state lighting device 314 in greater detail. As shown in FIG. 3C, the lighting device 314 includes a plurality of discrete light elements, such as LEDs 316A-316D mounted on the tile 312. The LEDs 316A-316D may be configured to emit light of different wavelengths, and may be covered in a clear encapsulant 315, such as a curable epoxy resin, which may provide mechanical and/or environmental protection for the LEDs 316A-316D. More particularly, the LEDs 316A-316D may include a red LED 316A, a blue LED 316B, and a green LED 316C. The blue and/or green LEDs 316B and/or 316C may be indium gallium nitride (InGaN)-based blue and/or green LED chips available from Cree, Inc., the assignee of the present invention. The red LED 316A may be, for example, an aluminum indium gallium phosphorous (AlInGaP) LED chip available from Epistar, Osram, and/or others. In addition, as the human eye is typically more sensitive to green light than red and/or blue light, the lighting element 314 may also include an additional green LED 316D in order to make more green light available and/or to provide greater luminance.

Referring again to FIG. 3A, in each solid state lighting device 314 on a particular bar assembly 330, same color LEDs may be serially connected in a string having a single cathode connection at one end of the string and a single anode connection at the other end of the string. Accordingly, each color LED on a bar 330 may be activated by the application of a single voltage, for example, from a lighting controller 305. More particularly, the lighting controller 305 may be configured to activate two different-color LEDs substantially simultaneously to generate a first image component including a combination of image data for the two different colors. The lighting controller 305 may also be configured to separately activate third color LEDs at a different time than the first and second color LEDs to generate a second image component including image data for the third color. The lighting controller 305 may be configured to alternate between simultaneously activating the two-different-color LEDs and separately activating the third color LEDs to sequentially provide the first and second image components, which may be sequentially displayed to provide a single image, for example, by the LCD display 200 of FIGS. 2A and 2B.

More particularly, referring to FIGS. 3A and 3C, the lighting controller 305 may substantially simultaneously activate the red LED 316A and the blue LED 316B in each solid state lighting device 314 of the lighting panel 300 to generate the first image component including a combination of red and blue color image data. The lighting controller 305 may also separately activate the green LEDs 316C and/or 316D at a different time than the red and blue LEDs 316A and 316B in each solid state lighting device 314 to generate the second image component including green color image data. The lighting controller 305 may be configured to alternate between separately activating the greens LED 316C and/or 316D and simultaneously activating the red and blue LEDs 316A and 316B to provide a single image frame. In addition, the lighting controller 305 may be configured to alternately activate the green LEDs 316C and/or 316D and the red and blue LEDs 316A and 316B at a predetermined frequency in order to provide a desired refresh rate. Moreover, in some embodiments, the lighting controller 305 may be configured to activate the red, green, and blue LEDs 316A-316D simultaneously to generate the first image component, and may separately activate the green LEDs 316C and/or 316D at a different time than the red and blue LEDs 316A and 316B to generate the second image component.

Although FIGS. 3A to 3C illustrate exemplary solid state lighting devices and methods of operation according to some embodiments of the present invention, it will be understood that some embodiments of the present invention are not limited to such a configuration, but is intended to encompass any configuration capable of carrying out the operations described herein. For example, while the embodiments illustrated in FIGS. 3A to 3C include four lighting elements 316A-316D per solid state lighting device 314, it will be appreciated that more and/or fewer than four lighting elements 316A-316D may be provided per lighting device 314. For instance, each lighting device 314 may include only three lighting elements, i.e., one of each of the red, blue, and green LEDs 316A-316C. In addition, the lighting controller 305 may be configured to simultaneously activate the red and green LEDs 316A and 316C to provide the first image component, and separately activate the blue LED 316B to provide the second image component. Alternatively, the lighting controller 305 may be configured to activate the blue and green LEDs 316B and 316C simultaneously to provide the first image component, and separately activate the red LED 316A to provide the second image component. In addition, although discussed above with reference to red, blue, and green lighting elements, other colored lighting elements may be used. More generally, the lighting controller 305 may be configured to simultaneously activate any two colored lighting elements and separately activate a third-color lighting element at a different time than the first- and second-colored lighting elements to generate the first and second image components, which may be sequentially displayed to provide a single image frame.

Figure 4A:
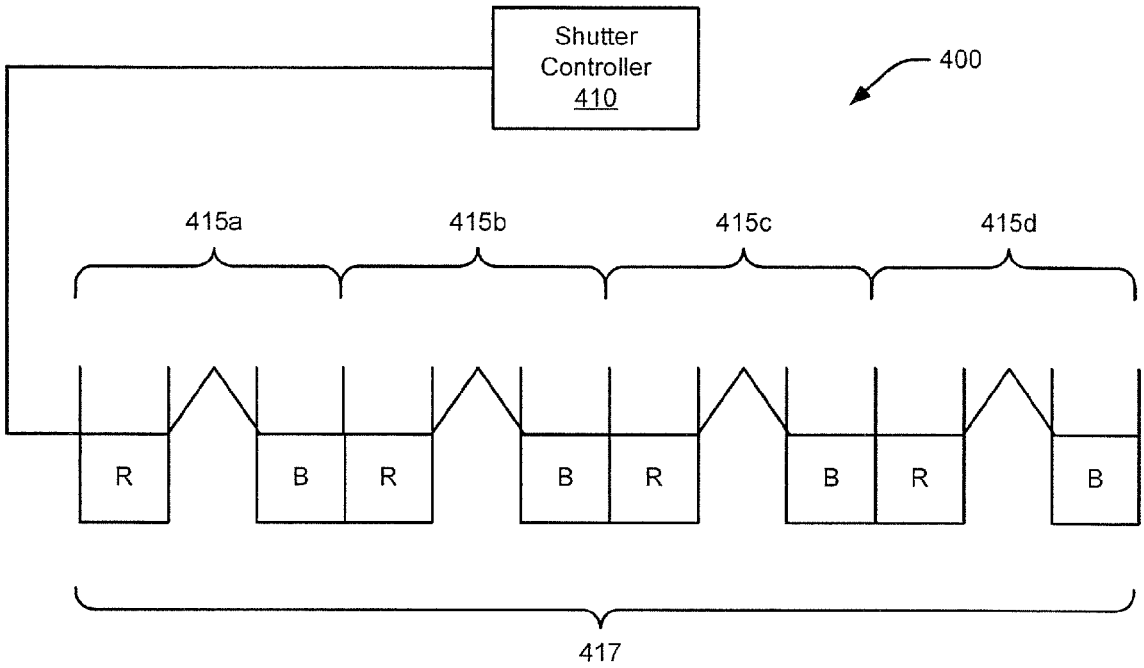
FIGS. 4A to 4E are block diagrams illustrating LCD screens and methods of operation according to some embodiments of the present invention.
Figure 4B:
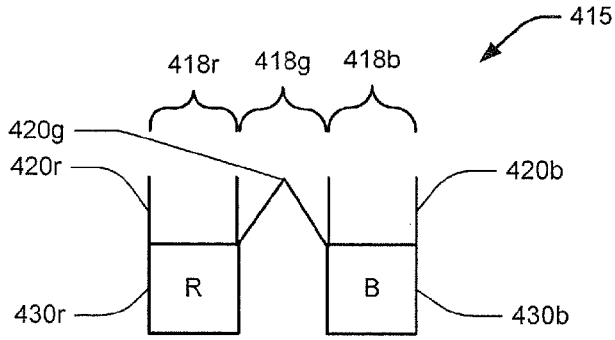

FIGS. 4A to 4E are diagrams illustrating an LCD screen and related methods of operation according to some embodiments of the present invention. Referring now to FIG. 4A, an LCD screen 400 includes a pixel array 417 including a plurality of pixels 415*a*-415*d* configured to display an image. As shown in FIG. 4B, each pixel 415 includes a first subpixel 418*r*, a second subpixel 418*b*, and a third subpixel 418*g*. The first, second, and third subpixels 418*r*, 418*b*, and 418*g* are respectively configured to display first, second, and third color image data. More particularly, the first subpixel 418*r* is configured to display red color image data, the second subpixel 418*b* is configured to display blue color image data, and the third subpixel 418*g* is configured to display green color image data. As such, the first subpixel 418*r* includes a first liquid crystal shutter 420*r* configured to be activated to an open position and a closed position, and a red color filter 430*r* to allow passage of red light and prevent passage of blue light. Similarly, the second subpixel 418*b* includes a second liquid crystal shutter 420*b* configured to be activated to an open position and a closed position, and a blue color filter 430*b* configured to allow passage of blue light and prevent passage of red light. The third subpixel 418*g* also includes a third liquid crystal shutter 420*g* configured to be activated to an open position and a closed position. However, the third subpixel 418*g* does not include a color filter.

Accordingly, referring again to FIG. 4A, a shutter controller 410 is configured to selectively activate the first and second liquid crystal shutters 420*r* and 420*b* to the open position and activate the third liquid crystal shutter 420*g* to the closed position to generate a first image component, which includes a combination of red and blue image color data. The shutter controller 410 is also configured to activate the third shutter 420*g* to the open position to generate a second image component, which includes green color image data. More specifically, the shutter controller 410 is configured to activate the third liquid crystal shutter 420*g* to the open position to allow passage of green light to generate the second image component, and is configured to activate the third shutter 420*g* to the closed position to prevent passage of red and/or blue light to generate the first image component. As such, the shutter controller 410 is configured to selectively activate the third liquid crystal shutter 420*g* to perform a filtering function, i.e., to allow passage of green light and prevent passage of red and blue light so that the third subpixel 418*g* may display green color image data without the use of a color filter.

Figures 4C, 4D, 4E:
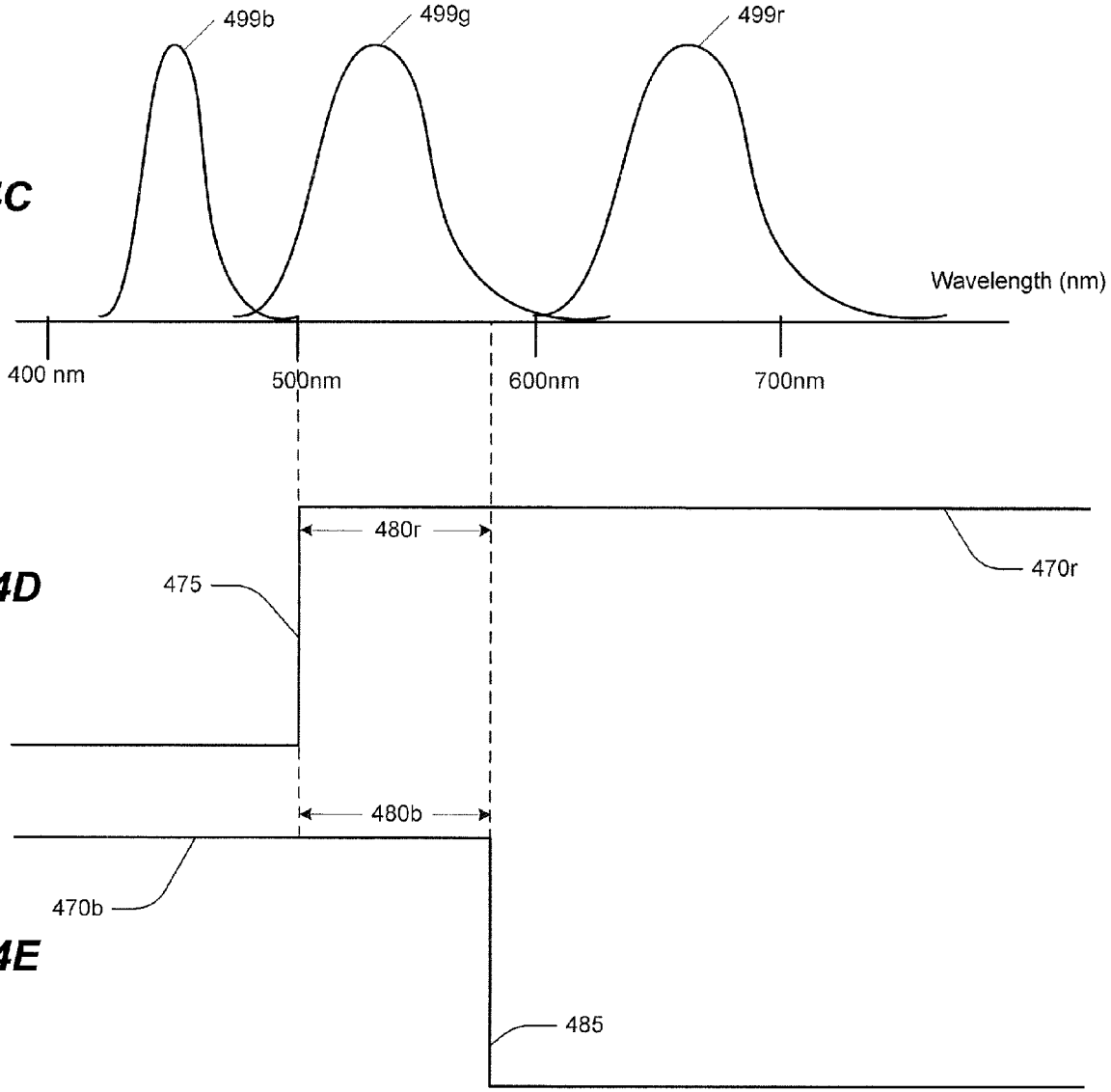

In addition, depending on the filtering characteristics of the red color filter 430*r* and/or the blue color filter 430*b*, the shutter controller 410 may be configured to selectively activate the first and/or second liquid crystal shutters 420*r* and/or 420*b* to the open and/or closed positions to generate the second image component. For example, in some embodiments, the color filters 430*r* and/or 430*b* may both be configured to allow passage of green light, and the shutter controller 410 may activate the shutters 420*r* and 420*b* to the closed position to generate the second image component. More particularly, FIG. 4C illustrates wavelengths corresponding to blue light 499*b*, green light 499*g*, and red light 499*r*, while FIGS. 4D and 4E illustrate transfer functions for the red and blue color filters 430*r* and 430*b*, respectively, according to some embodiments of the present invention. As shown in FIG. 4D, the red color filter 430*r* may be configured to allow passage of red light 499*r* but prevent passage of blue light 499*b*, as illustrated by transfer function 470*r*. The cutoff wavelength 475 of the red color filter 430*r* may be provided above the maximum wavelength of the blue light 499*b* to blocked, but well below the minimum wavelength of the red light 499*r* to be transmitted. As such, losses of portions of the red light 499*r* near the cutoff wavelength 475 of the red color filter 430*r* may be reduced and/or minimized. Similarly, as shown in FIG. 4E, the blue color filter 430*b* may be configured to allow passage of blue light 499*b* but prevent passage of red light 499*r*, as illustrated by transfer function 470*b*. The cutoff wavelength 485 of the blue color filter 430*b* may be provided below the minimum wavelength of the red light 499*r* to sufficiently block transmission thereof, but well beyond the maximum wavelength of the blue light 499*b* to be transmitted. Thus, losses of portions of the blue light 499*b* near the cutoff wavelength 485 of the blue color filter 430*b* may also be reduced and/or minimized. In addition, the transfer functions 470*r* and 470*b* may include overlapping portions 480*r* and 480*b* between the cutoff wavelengths 475 and 485, such that the color filters 430*r* and 430*b* may allow passage of at least a portion of the green light 499*g*. In other words, the red color filter 430*r* may be broadened to allow passage of all light having a wavelength greater than a maximum wavelength of the blue light 499*b*, and the blue color filter 430*b* may be broadened to allow passage of all light having a wavelength less then a minimum wavelength of the red light 499*r*, thereby increasing brightness and/or efficiency.

Accordingly, the shutter controller 410 may be configured to activate the shutters 420*r* and 420*b* to the closed position to generate the second image component when the color filters 430*r* and/or 430*b* are configured to allow passage of green light, such that the red color filter 430*r* may be configured to block only blue light, while the blue color filter 430*b* may be configured to block only red light. As such, losses of portions of the red light 499*r* and/or blue light 499*b* spectrum due to the presence of the color filters 430*r* and 430*b*, respectively, may be reduced. In other words, the shutter controller 410 may activate the third liquid crystal shutter 420*g* to the closed position when the first and second liquid crystal shutters 420*r* and 420*b* are in the open position to generate the first image component, and may activate the third liquid crystal shutter 420*g* to the open position when the first and second liquid crystal shutters 420*r* and 420*b* are in the closed position to generate the second image component.

However, referring again to FIG. 4B, if the color filters 430*r* and 430*b* are configured to prevent passage of green light, the shutter controller 410 may activate the first and/or second liquid crystal shutters 420*r* and/or 420*b* to the open position or to the closed position to generate the second image component. For example, if an electric charge must be applied to activate the liquid crystal shutters to the closed position, the shutter controller 410 may be configured to activate the first and second liquid crystal shutters 420*r* and 420*b* to the open position to generate the second image component, for example, to reduce power consumption. In addition, the shutter controller 410 may be configured to activate the liquid crystal shutters 420*r* and 420*b* to maintain the same positions (i.e., open or closed) used to generate the first image component during generation of the second image component, for example, in the event that at least some of the first and/or second liquid crystal shutters 420*r* and/or 420*b* may be activated to the same position to generate the first image component of the next image frame. More generally, the shutter controller 410 may be configured to activate the first and/or second liquid crystal shutters 420*r* and/or 420*b* to the open and/or closed positions to improve efficiency in generating the second image component based on the filtering characteristics of the color filters 430*r* and 430*b*.

In addition, the shutter controller 410 may be configured to accelerate a shutter rate of the first, second, and third shutters 420*r*, 420*b*, and 420*g* to provide a predetermined refresh rate for the displayed image. More particularly, as the LCD screen 400 is configured to sequentially display two image components in sequence in order to provide a single image, the shutter controller 410 may increase the shutter rate of the liquid crystal shutters 420*r*, 420*b*, and 420*g* by a factor of two in order to maintain a refresh rate comparable to that of a conventional LCD device.

Although FIGS. 4A to 4E illustrate an exemplary LCD screen and related elements according to some embodiments of the present invention, it will be understood that some embodiments of the present invention are not limited to such a configuration, but is intended to encompass any configuration capable of carrying out the operations described herein. For example, although the LCD screen 400 is illustrated as being configured to display red, green, and blue color image data using only red and blue color filters, it is to be understood that the LCD screen 400 may be configured to display the red, green, and blue color image data using any two color filters without using a filter of the third color. For example, in some embodiments, the second and third subpixels 418*b* and 418*g* of the LCD screen 400 may include blue and green color filters, respectively, and the first subpixel 418*r* may not include a color filter. Alternatively, the first and third subpixels 418*r* and 418*g* may include red and green color filters, respectively, and the second subpixel 418*b* may not include a color filter. In addition, although discussed above with reference to red, blue, and green filters, other color filters may be used as well. For example, the LCD screen 400 may be configured to display magenta, yellow, and cyan light using only magenta and cyan color filters. More generally, according to some embodiments of the present invention, the LCD screen 400 may be configured to display N colors of light using N−1 color filters. As such, the shutter controller 410 may be configured to activate the liquid crystal shutter associated with a filterless subpixel to the closed position and selectively activate the liquid crystal shutters associated with the other subpixels of each pixel to the open position to generate the first image component, and may be configured to selectively activate the liquid crystal shutter associated with the filterless subpixel to the open position to generate the second image component.

Figure 5:
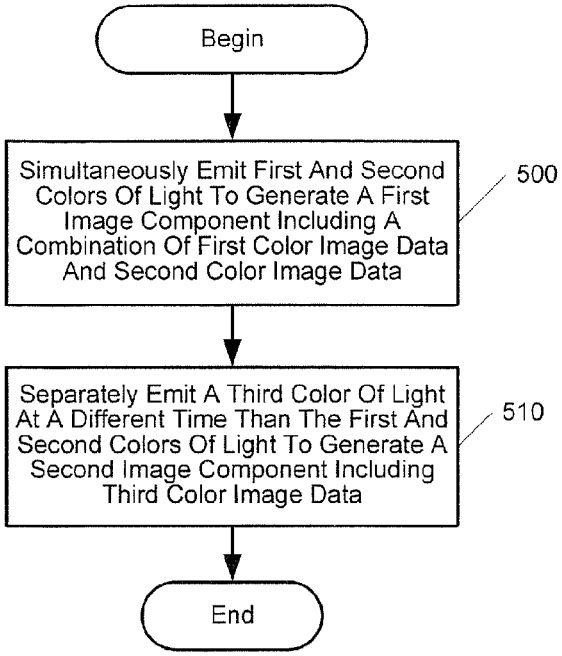
FIG. 5 is a flowchart illustrating operations that may be performed by a solid state lighting panel according to some embodiments of the present invention.

FIG. 5 is a flowchart illustrating exemplary operations that may be performed by a solid state lighting device according to some embodiments of the present invention. For example, the solid state lighting device may be a backlight, such as the backlight 202 of FIGS. 2A and 2B, for use in an LCD device, such as the LCD device 200. Referring now to FIG. 5, operations begin at Block 500 when first and second colors of light are simultaneously emitted to generate a first image component including a combination of first color image data and second color image data. For instance, red and blue light may be simultaneously emitted to generate a first image component including a combination of red color image data and blue color image data. At Block 510, a third color of light is separately emitted at a different time than the first and second colors of light to generate a second image component including third color image data. For example, green light may be emitted separately from the red light and blue light to generate a second image component including green color image data. More generally, any two colors of light may be simultaneously emitted to generate a first image component at Block 500, and a remaining third color of light may be emitted separately from the other two colors of light to generate the second image component at Block 510. As such, red and green light may be simultaneously emitted at Block 500, and blue light may be separately emitted at Block 510. Likewise, blue and green light may be simultaneously emitted at Block 500, and red light may be separately emitted at a different time at Block 510. The selection of the colors of light to be simultaneously and/or separately emitted may depend, for example, on the filter configuration of an LCD screen that is to be used with the solid state lighting device. For example, in some embodiments, red, blue, and green light may be simultaneously emitted at Block 500, and the green light may be filtered by one or more color filters to generate the first image component including the red and blue color image data. Accordingly, the first image component (including a combination of color image data for two colors) and second image component (including color image data for the third color) may be sequentially displayed in order to provide a single image frame.

In addition, in some embodiments, the first and second image components may be sequentially generated at Blocks 500 and 510 at a predetermined frequency to provide a desired refresh rate for the displayed image. For example, the operations of Blocks 500 and 510 may be alternated to sequentially generate the second and first image components in accordance with a shutter rate of a plurality of liquid crystal shutters configured to display the first and second image components. More particularly, the first and second image components may be generated at Blocks 500 and 510 based on an accelerated shutter rate, such that an image may be displayed at a refresh rate comparable to that of a conventional LCD device.

Figure 6:
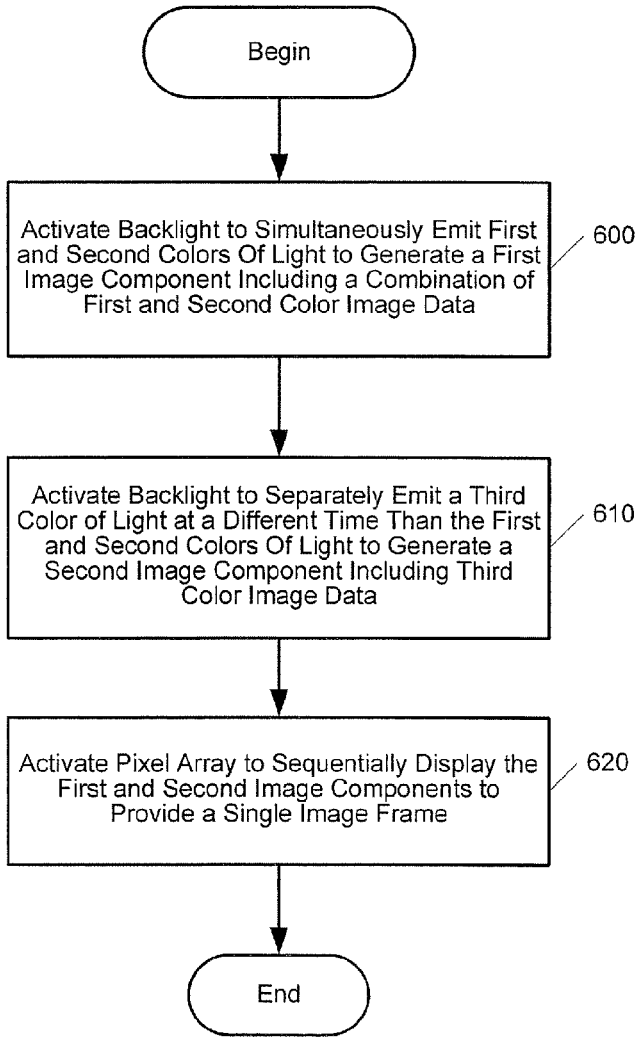
FIG. 6 is a flowchart illustrating operations that may be performed by an LCD device according to some embodiments of the present invention.

FIG. 6 is a flowchart illustrating exemplary operations that may be performed by a liquid crystal display device including a backlight and a pixel array according to some embodiments of the present invention, such as the LCD device 200 of FIGS. 2A and 2B. Referring now to FIG. 6, operations begin at Block 600 when the backlight is activated to simultaneously emit first and second colors of light to generate a first image component. The first image component includes a combination of first and second color image data. For example, the backlight may be activated to simultaneously emit red and blue light, and as such, the first image component may include a combination of both red and blue color image data. At Block 610, the backlight is activated to separately emit a third color of light at a different time than the first and second colors of light to generate a second image component. The second image component includes third color image data. For example, the backlight may be activated to emit green light separately from the red and blue light, and as such, the second image component may include green color image data. However, as discussed above, the backlight may be activated to emit any two colors of light simultaneously to generate a first image component at Block 600, and may be activated to emit a remaining third color of light separately from the other two colors of light to generate the second image component at Block 610.

Still referring to FIG. 6, the pixel array is activated to display the first image component and the second image component to provide a single image frame at Block 620. For example, the pixel array may be activated to rapidly display, in sequence, an image component including green color image data followed by an image component including a combination of red and blue color image data, such that a user and/or viewer of the LCD device may perceive a single full-color image. As such, the pixel array may be activated in coordination with the backlight to display any two-image component sequence at Block 620, where one image component includes only one of red, green, or blue color image data, and where the other image component includes a combination of color image data for the remaining two colors. More particularly, the liquid crystal shutters of each subpixel of the pixel array may be selectively activated in synchronization with the output of the backlight, as will be discussed in greater detail below.

Figure 7:
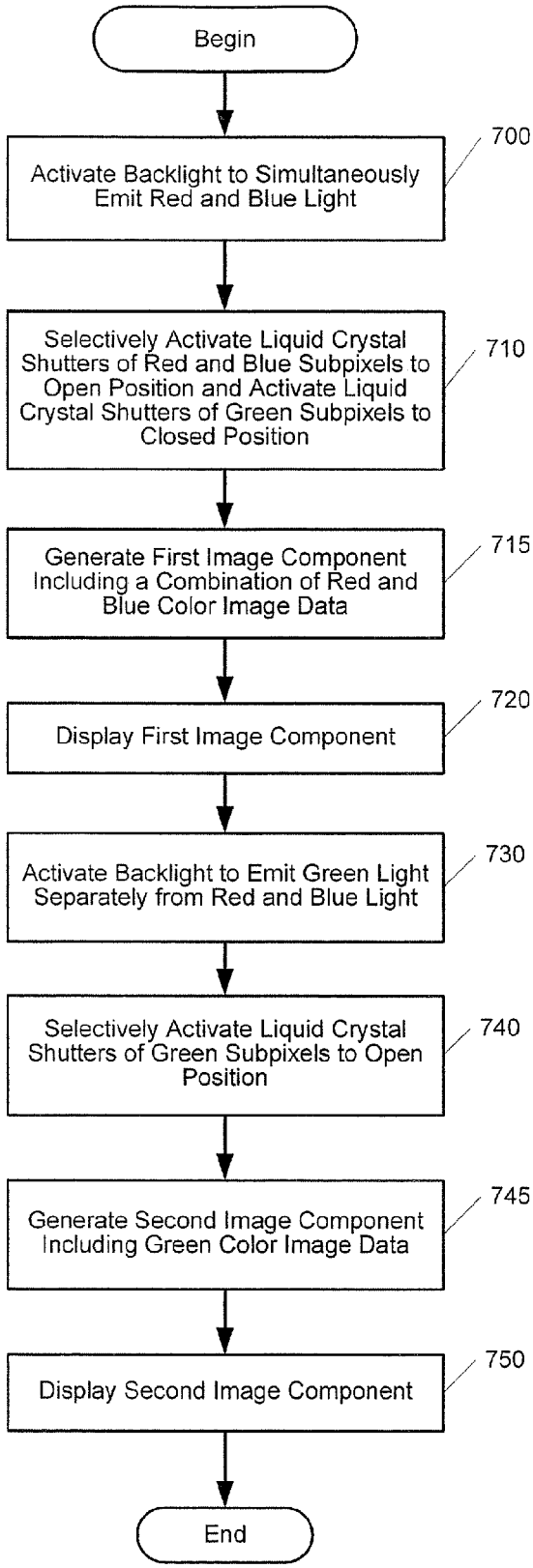
FIG. 7 is a flowchart illustrating further operations that may be performed by an LCD device according to some embodiments of the present invention.

FIG. 7 is a flowchart illustrating more detailed operations that may be performed by a liquid crystal display device including a backlight and a pixel array according to some embodiments of the present invention. Referring now to FIG. 7, operations begin at Block 700 when the backlight is activated to simultaneously emit red and blue light. For example, the backlight may include red, blue, and green solid state lighting elements, such as LEDs, and the red and blue lighting elements may be activated substantially simultaneously to emit the red and blue light. Concurrently, at Block 710, the liquid crystal shutters associated with the red and blue subpixels of each pixel of the pixel array are selectively activated to an open position, and the liquid crystal shutters associated with the green subpixel of each pixel of the pixel array are activated to a closed position. As such, red color filters associated with the red subpixels may allow passage of the red light and prevent passage of the blue light, while blue color filters associated with the blue subpixels may allow passage of the blue light and prevent passage of the red light. In addition, as the liquid crystal shutters associated with the green subpixels are activated to the closed position, the green subpixels may be configured to prevent the passage of red and blue light therethrough without the use of a color filter. In other words, the liquid crystal shutters associated with the green subpixels may be selectively activated to perform a filtering function. Accordingly, red color image data displayed by the red subpixels and blue color image data displayed by the blue subpixels may be combined to generate a first image component at Block 715. The first image component including the combination of the red and blue color image data is displayed by the pixel array at Block 720.

Still referring to FIG. 7, the backlight is activated to separately emit green light at a different time than red and blue light at Block 730. For example, where the backlight includes red, blue, and green solid state lighting elements, the green solid state lighting element may be activated at a different time than the red and blue solid state lighting elements to emit the green light separately from the red and blue light. Concurrently, at Block 740, the liquid crystal shutters associated with the green subpixels are selectively activated to the open position to allow passage of the green light. The liquid crystal shutters associated with the red and blue subpixels may also be activated to the closed position when the backlight is activated to emit green light to prevent passage of the green light therethrough. However, in some embodiments, the red and blue color filters associated with the red and blue subpixels may be configured to prevent passage of green light, and as such, the liquid crystal shutters associated with the red and/or blue subpixels may be activated to the open position when the backlight is activated to emit green light. Thus, a second image component including green color image data is generated at Block 745. The second image component including the green color image data is displayed by the pixel array at Block 750.

Accordingly, as illustrated in FIG. 7, first and second subpixels of each pixel in the pixel array may be selectively activated when the backlight is activated to simultaneously emit first and second colors of light to generate a first image component, and a third subpixel of each pixel of the pixel array may be selectively activated when the backlight is activated to separately emit a third color of light at a different time than the first and second colors to generate a second image component. The first and second image components may be sequentially displayed to provide a single image frame.

The operations of FIG. 7 may be performed to activate the pixel array and the backlight to sequentially display the first image component and the second image component in rapid succession, such that a single full-color image frame may be perceived by a viewer. As such, the rate at which the pixel array may sequentially display the first and second image components may be dependent on the switching speed of the liquid crystal shutters and/or the lighting elements of the backlight. For instance, to sequentially display the first and second image components at an image refresh rate comparable to that of a conventional liquid crystal display, a shutter rate of the liquid crystal shutters may be accelerated. More specifically, to provide each two-image sequence, the shutter rate of the liquid crystal shutters may be doubled. As the switching rate of the lighting elements of the backlight may be significantly faster than the shutter rate of the liquid crystal shutters, the backlight may be activated based on the shutter rate of the liquid crystal shutters. More particularly, the backlight may be activated to simultaneously emit the red and blue light at Block 700 when the liquid crystal shutters associated with the green subpixels are activated to the closed position at Block 710, and may be activated to separately emit the green light at a different time than the red and blue light at Block 730 when the liquid crystal shutters associated with the green subpixels are activated to the open position at Block 740. As such, in some embodiments, the refresh rate of the LCD device may be dependent on a maximum shutter rate of the liquid crystal shutters.

The flowcharts of FIGS. 5 through 7 illustrate exemplary operations of some solid state lighting devices and/or liquid crystal display devices according to embodiments of the present invention. In this regard, each block may represent a module, segment, or portion of code, which may comprise one or more executable instructions for implementing the specified logical functions. It should also be noted that in other implementations, the functions noted in the blocks may occur out of the order noted in the figures. For example, two blocks shown in succession may, in fact, be executed substantially concurrently, or the blocks may sometimes be executed in the reverse order, depending on the functionality involved. More particularly, although the flowcharts of FIGS. 5 through 7 illustrate generating and/or displaying the first image component prior to the second image component, it is to be understood that the blocks may be executed such that the second image component is generated and/or displayed prior to the first image component.

In the drawings and specification, there have been disclosed typical embodiments of the invention, and, although specific terms are employed, they are used in a generic and descriptive sense only and not for purposes of limitation, the scope of the invention being set forth in the following claims.

That which is claimed:

1. A liquid crystal display (LCD) device, comprising:

a backlight configured to emit first, second, and third colors of light; and a backlight controller configured to activate the backlight to simultaneously emit the first and second colors of light to generate a first image component including a combination of first color image data and second color image data, and to separately emit the third color of light at a different time than the first and second colors of light to generate a second image component including third color image data; and a pixel array including a plurality of pixels configured to sequentially display the first and second image components to provide the image, wherein the plurality of pixels respectively comprise:

a first subpixel configured to display the first color image data, the first subpixel including a first liquid crystal shutter configured to be activated to an open position and a closed position, and a first color filter configured to allow passage of the first color of light and prevent passage of the second color of light;

a second subpixel configured to display the second color image data, the second subpixel including a second liquid crystal shutter configured to be activated to an open position and a closed position, and a second color filter configured to allow passage of the second color of light and prevent passage of the first color of light; and a third subpixel configured to display the third color image data, the third subpixel including a third liquid crystal shutter configured to be activated to an open position and a closed position, wherein the third subpixel is configured to allow passage of the first and/or second colors of light in the open position, wherein the LCD device is configured to display the first and second image components to provide a single image frame.

2. The device of claim 1, wherein the third subpixel does not include a color filter.

3. The device of claim 2, further comprising:

a shutter controller configured to selectively activate the first and second liquid crystal shutters to the open position and activate the third liquid crystal shutter to the closed position to generate the first image component, and configured to selectively activate the third liquid crystal shutter to the open position to generate the second image component.

4. The device of claim 3, wherein the shutter controller is configured to activate the third liquid crystal shutter to the closed position when the backlight is activated to simultaneously emit the first and second colors of light to prevent passage of the first and second colors of light.

5. The device of claim 4, wherein the shutter controller is further configured to selectively activate the first and second liquid crystal shutters to the open position when the backlight is activated to simultaneously emit the first and second colors of light to combine the first color image data and the second color image data.

6. The device of claim 3, wherein the shutter controller is configured to selectively activate the third liquid crystal shutter to the open position when the backlight is activated to emit the third color of light to allow passage of the third color of light.

7. The device of claim 6, wherein the shutter controller is further configured to activate the first and second liquid crystal shutters to the closed position when the backlight is activated to emit the third color of light.

8. The device of claim 7, wherein the first and second color filters are configured to allow passage of the third color of light.

9. The device of claim 6, wherein the first and second color filters are further configured to prevent passage of the third color of light, and wherein the shutter controller is further configured to activate the first and/or second liquid crystal shutters to the open position when the backlight is activated to emit the third color of light.

10. The device of claim 3, wherein the first and second color filters are further configured to prevent passage of the third color of light, and wherein the backlight controller is configured to simultaneously emit the first, second, and third colors of light to generate the first image component.

11. The device of claim 2, wherein the backlight controller is configured to alternately activate the backlight to emit the first and second colors of light simultaneously and activate the backlight to emit the third color of light at a different time than the first and second colors of light based on a shutter rate of the first, second, and/or third liquid crystal shutters.

12. The device of claim 1, wherein the backlight comprises a solid state lighting panel comprising:

a first solid state lighting element configured to emit the first color of light;

a second solid state lighting element configured to emit the second color of light; and a third solid state lighting element configured to emit the third color of light;

wherein the backlight controller is configured to activate the first and second solid state lighting elements substantially simultaneously to generate the first image component, and to activate the third solid state lighting element at a different time than the first and second solid state lighting elements to generate the second image component.

13. The device of claim 1, wherein a wavelength of the third color of light is greater than a wavelength of the second color of light but less than a wavelength of the first color of light.

14. The device of claim 13, wherein the first color of light comprises red light, wherein the second color of light comprises blue light, and wherein the third color of light comprises green light.

15. The device of claim 1, wherein the first color of light comprises blue light, wherein the second color of light comprises green light, and wherein the third color of light comprises red light.

16. The device of claim 1, wherein the first color of light comprises green light, wherein the second color of light comprises red light, and wherein the third color of light comprises blue light.

17. A screen for use in a liquid crystal display (LCD) device, comprising:

a pixel array including a plurality of pixels configured to display an image, wherein the plurality of pixels respectively comprise:

a first subpixel configured to display first color image data, the first subpixel including a first liquid crystal shutter configured to be activated to an open position and a closed position, and a first color filter configured to allow passage of a first color of light and prevent passage of a second color of light;

a second subpixel configured to display second color image data, the second subpixel including a second liquid crystal shutter configured to be activated to an open position and a closed position, and a second color filter configured to allow passage of the second color of light and prevent passage of the first color of light; and a third subpixel configured to display third color image data, the third subpixel including a third liquid crystal shutter configured to be activated to an open position and a closed position, wherein the third subpixel does not include a color filter.

18. The screen of claim 17, further comprising:

a shutter controller configured to selectively activate the first and second liquid crystal shutters to the open position to generate a first image component including a combination of the first color image data and the second color image data, and to selectively activate the third liquid crystal shutter to the open position to generate a second image component including the third color image data, wherein the pixel array is configured to sequentially display the first and second image components to provide the image.

19. The screen of claim 18, wherein the shutter controller is configured to activate the third liquid crystal shutter to the closed position to generate the first image component.

20. The screen of claim 18, wherein the shutter controller is further configured to activate the first and second liquid crystal shutters to the closed position to generate the second image component.

21. The screen of claim 20, wherein the first and second color filters are configured to allow passage of the third color of light.

22. The screen of claim 18, wherein the first and second color filters are further configured to prevent passage of the third color of light, and wherein the shutter controller is further configured to activate the first and/or second liquid crystal shutters to the open position to generate the second image component.

23. The screen of claim 17, wherein a wavelength of the third color is greater than a wavelength of the second color but less than a wavelength of the first color.

24. The screen of claim 23, wherein the first color comprises red, wherein the second color comprises blue, and wherein the third color comprises green.

25. The screen of claim 17, wherein the first color comprises blue, wherein the second color comprises green, and wherein the third color comprises red.

26. The screen of claim 17, wherein the first color comprises green, wherein the second color comprises red, and wherein the third color comprises blue.

27. A method for operating a liquid crystal display (LCD) device including a backlight and a pixel array, the method comprising:

activating the backlight to simultaneously emit first and second colors of light to generate a first image component including a combination of first color image data and second color image data;

activating the backlight to separately emit a third color of light at a different time than the first and second colors of light to generate a second image component including third color image data; and activating the pixel array to display the first and second image components to provide a single image frame, wherein the pixel array includes a plurality of pixels respectively comprising first, second, and third subpixels configured to display first, second, and third color image data, respectively, wherein the first, second, and third subpixels include first, second, and third liquid crystal shutters, respectively, wherein each of the liquid crystal shutters is configured to be activated to an open position and a closed position, and wherein the first and second subpixels include first and second color filters, respectively, wherein the first color filter is configured to allow passage of the first color of light and prevent passage of the second color of light, wherein the second color filter is configured to allow passage of the second color of light and prevent passage of the first color of light, and wherein the third subpixel is configured to allow passage of the first and/or second colors of light in the open position.

28. The method of claim 27, wherein the third subpixel does not include a color filter, and wherein activating the pixel array further comprises:

selectively activating the first and second liquid crystal shutters to an open position and activating the third liquid crystal shutter to a closed position to generate the first image component; and selectively activating the third liquid crystal shutter to an open position to generate the second image component.

29. The method of claim 28, wherein activating the third liquid crystal shutter to the closed position comprises:

activating the third liquid crystal shutter to the closed position concurrently with activating the backlight to simultaneously emit the first and second colors of light to prevent passage of the first and second colors of light.

30. The method of claim 29, wherein selectively activating the first and second liquid crystal shutters comprises:

selectively activating the first and second liquid crystal shutters to the open position concurrently with activating the backlight to simultaneously emit the first and second colors of light to combine the first color image data and the second color image data.

31. The method of claim 28, wherein selectively activating the third liquid crystal shutter to the open position comprises:

selectively activating the third liquid crystal shutter to the open position concurrently with activating the backlight to emit the third color of light to allow passage of the third color of light.

32. The method of claim 31, further comprising:

activating the first and second liquid crystal shutters to the closed position concurrently with activating the backlight to emit the third color of light.

33. The method of claim 31, wherein the first and second subpixels respectively include first and second color filters configured to prevent passage of the third color of light, and further comprising:

activating the first and/or second liquid crystal shutters to the open position concurrently with activating the backlight to emit the third color of light.

34. The method of claim 28, wherein the first and second subpixels respectively include first and second color filters configured to prevent passage of the third color of light, and wherein activating the backlight to simultaneously emit first and second colors of light further comprises:

activating the backlight to simultaneously emit the first, second, and third colors of light to generate the first image component.

35. The method of claim 28, further comprising:

alternating between activating the backlight to emit the first and second colors of light simultaneously and activating the backlight to emit the third color of light based on a shutter rate of the first, second, and/or third liquid crystal shutters.

36. The method of claim 28, wherein the backlight comprises first, second, and third solid state lighting elements respectively configured to emit light of the first, second, and third colors, and wherein activating the backlight to simultaneously emit first and second colors of light and activating the backlight to emit the third color of light comprises:

activating the first and second solid state lighting elements substantially simultaneously to generate the first image component; and activating the third solid state lighting element at a different time than the first and second solid state lighting elements to generate the second image component.

37. The method of claim 27, wherein a wavelength of the third color of light is greater than a wavelength of the second color of light but less than a wavelength of the first color of light.

38. The method of claim 37, wherein the first color of light comprises red light, wherein the second color of light comprises blue light, and wherein the third color of light comprises green light.

39. The method of claim 27, wherein the first color of light comprises blue light, wherein the second color of light comprises green light, and wherein the third color of light comprises red light.

40. The method of claim 27, wherein the first color of light comprises green light, wherein the second color of light comprises red light, and wherein the third color of light comprises blue light.

* * * * *